United States Patent [19]

Artusi

[11] Patent Number: 4,718,483

[45] Date of Patent: Jan. 12, 1988

[54] HEAT EXCHANGER WITH EXTERNALLY ENAMELLED BAYONET-TUBES

[75] Inventor: Gianni Artusi, Venice, Italy

[73] Assignee: Tycon Spa, San Dona di Piave, Italy

[21] Appl. No.: 839,099

[22] Filed: Mar. 13, 1986

[30] Foreign Application Priority Data

Apr. 23, 1985 [IT] Italy ..... 20459 A/85

[51] Int. Cl.[4] ..... F28D 7/12

[52] U.S. Cl. ..... 165/142; 285/267

[58] Field of Search ..... 165/142; 285/267, 375

[56] References Cited

U.S. PATENT DOCUMENTS

| | | | |
|---|---|---|---|
| 2,499,608 | 3/1950 | Rink | 165/142 |
| 4,106,556 | 8/1978 | Heyn et al. | 165/142 X |
| 4,140,172 | 2/1979 | Corey | 165/142 |
| 4,142,580 | 3/1979 | Bailey | 165/142 |
| 4,427,220 | 1/1984 | Decker | 285/267 X |

*Primary Examiner*—Albert W. Davis, Jr.
*Assistant Examiner*—Peggy A. Neils
*Attorney, Agent, or Firm*—Stevens, Davis, Miller & Mosher

[57] ABSTRACT

A heat exchanger with a tube bundle constituted by externally enamelled bayonet-tubes which are individually fixed to a tube plate using a special system of sealing by pressing against a frustoconical seat, and which comprises preferably a single PTFE gasket for the entire tube bundle.

4 Claims, 2 Drawing Figures

HEAT EXCHANGER WITH EXTERNALLY ENAMELLED BAYONET-TUBES

This invention relates to a new type of heat exchanger constituted by externally enamelled bayonet-tubes. More particularly, the invention relates to a type of heat exchanger in which the enamelled tubes are fixed individually to the tube plate by a new method which offers particular advantages in terms of seal effectiveness, efficiency and life of the equipment.

Heat exchangers with an enamelled tube bundle are known, but these have several drawbacks, because of which they have found little application up to the present time.

In particular, problems exist in fixing the tubes to the tube plate. This is because currently available enamelled heat exchangers are constructed with a tube plate which is enamelled or coated with attack-resistant materials such as PTFE, and to which the various bayonet-tubes are fixed using a sealing system which is of poor reliability.

Fixed tube-bundle heat exchangers have also been constructed by welding the individual tubes to the metal plate and then enamelling both the tubes and the plate.

For this type of heat exchanger, the enamelling is extremely difficult and is often defective, so that the equipment is subject to corrosion during its use with corrosive process liquids.

In addition, both with a removable tube construction and, more particularly, with a welded tube construction, the pitch which has to be used between the various tubes in order to obtain a simple and reliable apparatus is so large as to make the exchanger poorly efficient and particularly costly.

These drawbacks are obviated by the heat exchanger according to the present invention, which ensures a seal of high reliability, prevents the possibility of defects or cracks in the enamelling, and enables a reduced pitch to be used between the tubes to thus attain high heat transfer surfaces per unit of volume.

In addition, as the tubes of the heat exchanger according to the invention are fixed individually, they can be rapidly replaced in the case of breakage. The heat exchanger with externally enamelled bayonet-tubes according to the present invention is characterised in that said tubes comprise, in proximity to the head, a suitably frusto-conically machined portion arranged to fit in a sealed manner into a corresponding seat provided in the inner tube plate, the seal being provided by a PTFE gasket kept elastic by a cup spring.

These and further characteristics and advantages of the heat exchanger with enamelled bayonet-tubes according to the present invention will be more apparent from the detailed description given hereinafter with reference to the figures, which show a preferred embodiment of the invention and are given by way of non-limiting example.

Figure 1:
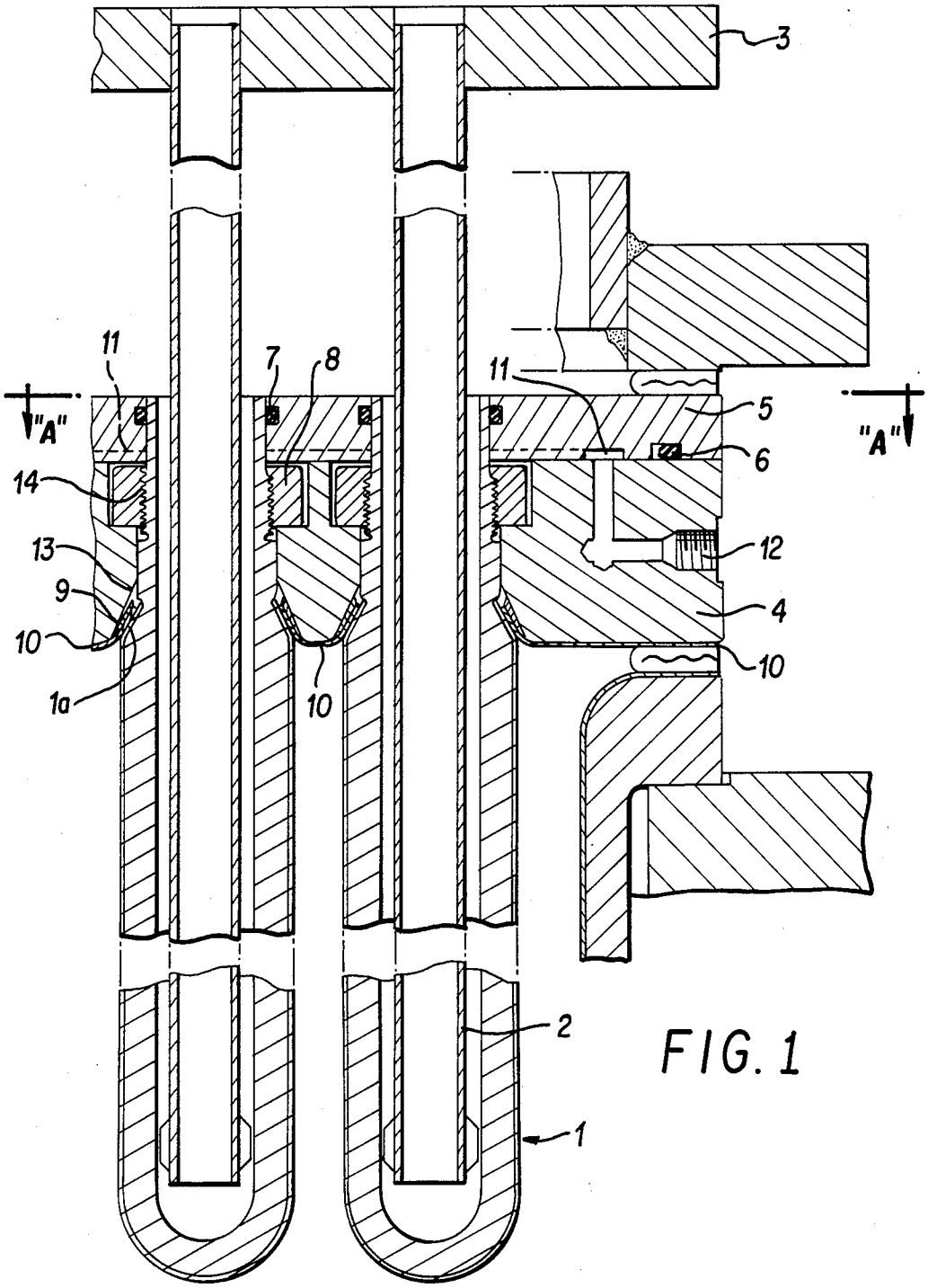
FIG. 1 is a vertical section through a part of the heat exchanger.
Figure 2:
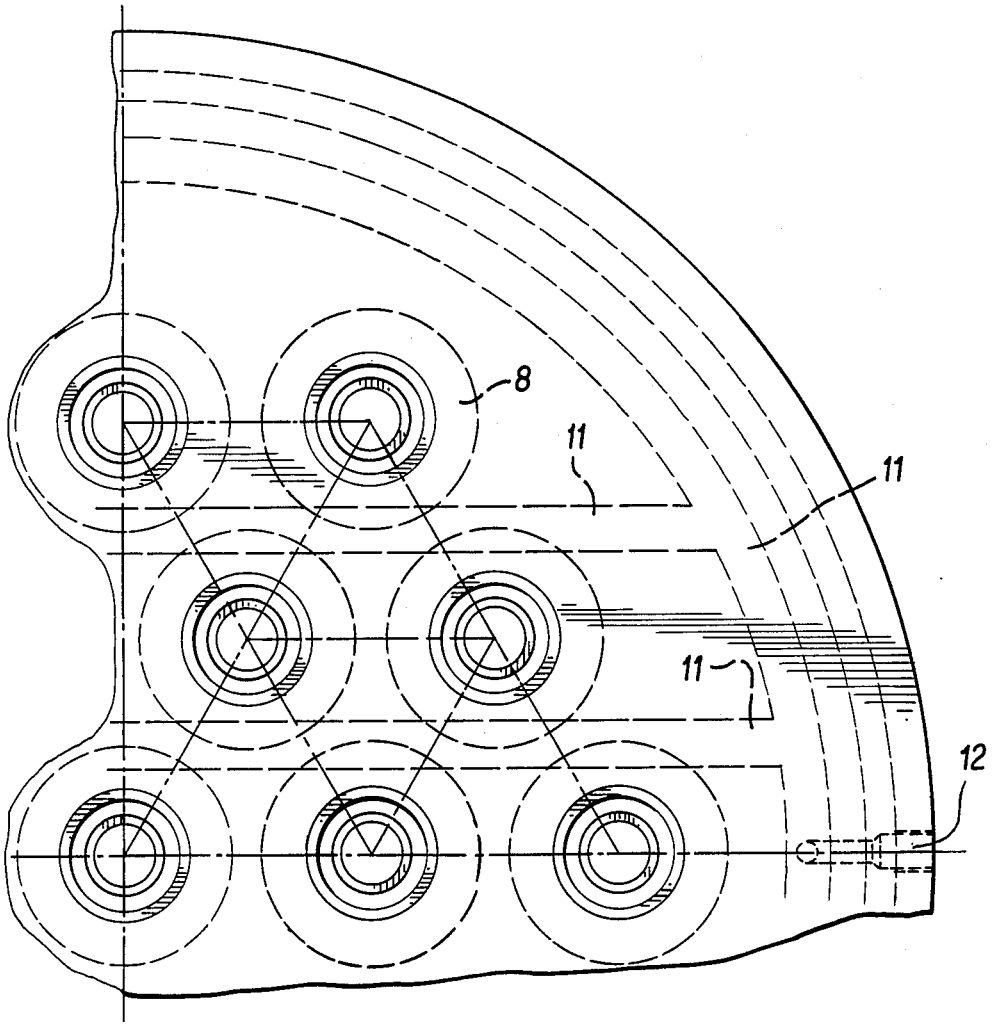
FIG. 2 is a cross-section corresponding to the section A—A of FIG. 1.

Referring to the reference letters and numerals shown in the figures, the heat exchanger is constituted by a series of enamelled tubes 1 which comprise a frusto-conical portion 1*a* in proximity to the head.

At their upper end, the enamelled tubes 1 comprise a thread 14 for screwing the ring nut 8.

Inside the enamelled tubes 1 and coaxial therewith there are located tubes 2, which are either welded to or expanded into the outer tube plate 3.

The inner tube plate 4 comprises the seats 13 for the enamelled tubes, they being of frusto-conical termination but with a lesser taper than that of the frusto-conical portion 1*a* of the enamelled tubes 1.

These seats internally house the steel cup springs 9, having a taper equal to that of the frusto-conical portion 1*a* of the tube and greater than that of the seat 13.

The result is that the cup springs rest on their inner side completely against the frusto-conical portion 1*a* of the enamelled tube by way of the PTFE gasket 10, whereas on their outer side they rest only against the greater-diameter zone of the frusto-conical seat of the tube plate.

On tightening the ring nut 8, the tube becomes fixed to the tube plate 4 to form a high-efficiency seal with a pressure on the gasket 10 which varies from the major base to the minor base of the cone frustum.

The pressure on the gasket is maintained with time, and is ensured even if temperature changes occur, by virtue of the cup spring 9 which having a free end provides the necessary elasticity to the entire system.

A single PTFE gasket 10 is provided to accomodate all the tubes, being cup-shaped in each position corresponding with a tube, and besides forming a seal element it covers the entire surface of the inner tube plate 4, so making its enamelling superfluous.

The ring nut 8 and thread 14 are protected from contact with the cooling or heat fluid by means of a backing plate 5, which seals against the upper end of the enamelled tube 1 by means of an O-ring 7.

The backing plate 5 comprises channels 11 through which any leakages of cooling or heating fluid or of process fluid are conveyed to the outside through the outlet 12. A detector can be installed at the leakage outlet to sound an alarm in order to enable the plant to be shut down.

Thus if the O-ring 7 or gasket 10 does not provide a perfect seal, the leakages are conveyed through the channel 11 to the outlet 12. The cooling or heating fluid is fed to the tube bundle through an inlet pipe (not shown) fitted to the head, enters the tubes 1, flows along their whole length through the interspace between said tubes 1 and the inner tubes 2, then rises again along the tubes 2 to leave them at the outer tube plate 3.

The cooling or heating fluid can also circulate in the opposite direction.

From the foregoing description and the illustrated figures it is apparent that the heat exchanger according to the invention attains the proposed objects, and in particular enables effective seals to be obtained between the tubes, which are of reduced pitch.

What is claimed is:

1. A heat exchanger with a plurality of externally enamelled bayonet tubes comprising:

a tube plate having an inner surface and outer surface with a plurality of tube mounting apertures and means for mounting said plurality of bayonet tubes in said apertures so that they project outwardly from said inner surface;

each tube mounting aperture having a frusto-conical seat adjacent the outer surface of the plate and each bayonet tube having a frusto-conical portion for fitting in a sealing manner into one of said frusto-conical seats;

a PTFE sheet overlying the entire inner surface of said tube plate and having a plurality of apertures positioned to correspond with said tube plate apertures and cup shaped portions around the apertures in the sheet;

a plurality of cup springs within the tube plate apertures positioned to press the PTFE sheet against the frusto-conical portion of the bayonet tubes to seal the seating between the tubes and the plate.

2. A heat exchanger as claimed in claim 1, in which said frusto-conical seat provided in the inner tube plate is of lesser taper than said frusto-conically machined portion of the tubes.

3. A heat exchanger as claimed in claim 1, in which said cup spring is made of steel and keeps the PTFE gasket constantly pressed against the frusto-conical portion of the tube.

4. A heat exchanger as claimed in claim 1, including a backing plate overlying the outer surface of said tube plate and a channel provided in the backing plate to convey any leakages of fluid to the outside, through an outlet connected to said channel.

* * * * *